US006397506B1

(12) United States Patent
Oglesby, Jr.

(10) Patent No.: US 6,397,506 B1
(45) Date of Patent: Jun. 4, 2002

(54) SINGLE-ACTION REVOLVER WITH ACTUATING ROD

(76) Inventor: William D. Oglesby, Jr., 7773 Outer Dr., Sherman, IL (US) 62684

( * ) Notice: Subject to any disclaimer, the term of this patent is extended or adjusted under 35 U.S.C. 154(b) by 0 days.

(21) Appl. No.: 09/469,416

(22) Filed: Dec. 23, 1999

Related U.S. Application Data

(60) Provisional application No. 60/114,855, filed on Jan. 6, 1999.

(51) Int. Cl.[7] ..... F41A 19/52
(52) U.S. Cl. ..... 42/59; 42/65
(58) Field of Search ..... 42/59, 65

(56) References Cited

U.S. PATENT DOCUMENTS 1,487,722 A * 3/1924 Coenders
4,159,670 A * 7/1979 Turner ..... 89/155
5,416,999 A * 5/1995 Coury ..... 42/59
5,727,345 A * 3/1998 Sullivan ..... 42/59

* cited by examiner

*Primary Examiner*—Stephen M. Johnson
(74) *Attorney, Agent, or Firm*—Philip L. Bateman

(57) ABSTRACT

A single-action revolver can be fired rapidly by relatively unskilled shooters and by shooters with limited manual dexterity. The revolver contains a hammer-cocking assembly having a reciprocating cylinder-actuating rod with a proximate end that passes rearwardly through the respective longitudinal bores of the frame and cylinder to contact the hammer and with a distal end that extends forwardly along the barrel. A shooter can easily fire the revolver rapidly by first moving the cylinder-actuating rod with one hand to cock the hammer and rotate the cylinder, and by then pulling the trigger with another hand to release the hammer and fire the revolver.

6 Claims, 5 Drawing Sheets

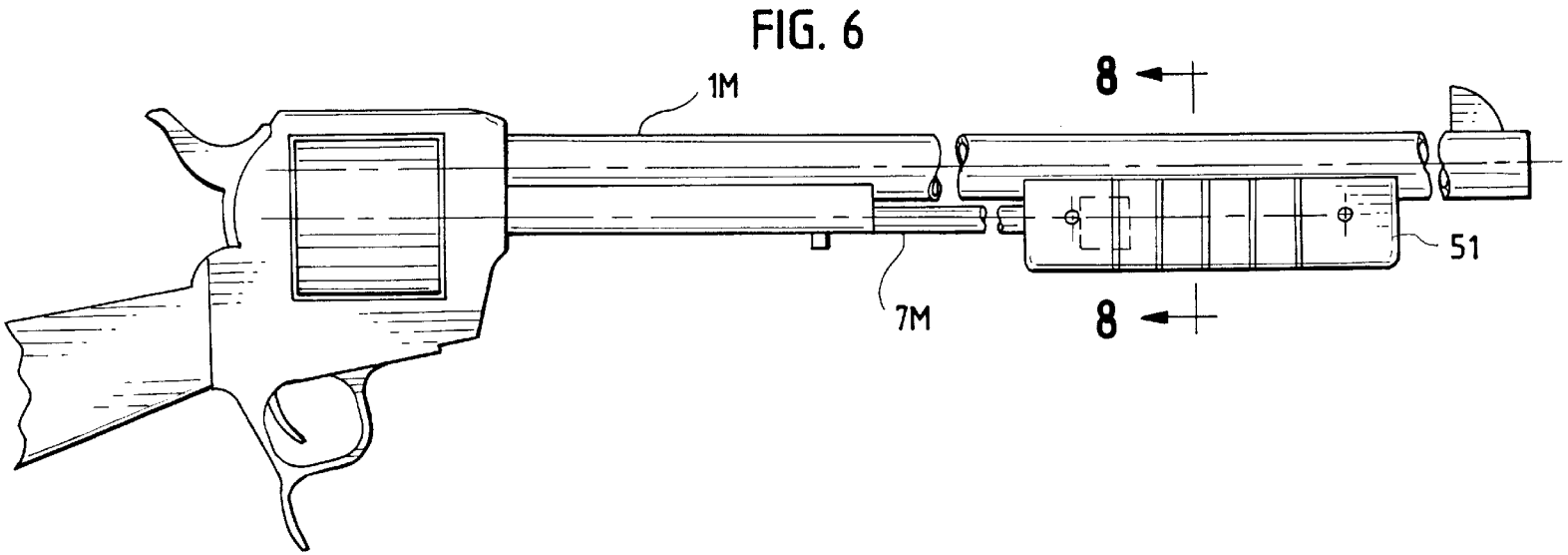
FIG. 6
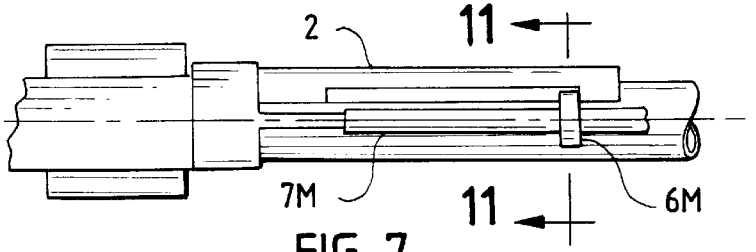
FIG. 7
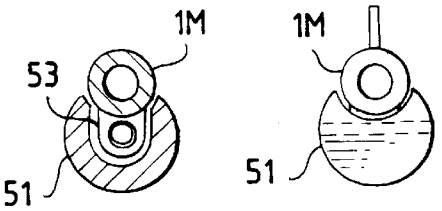
FIG. 8
FIG. 9
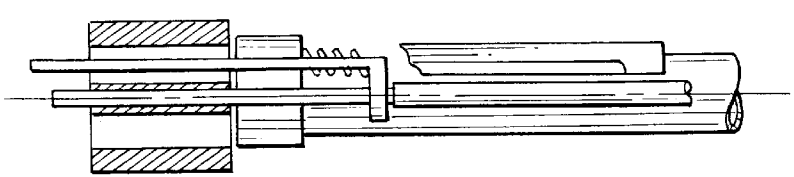
FIG. 10
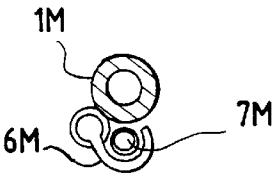
FIG. 11

SINGLE-ACTION REVOLVER WITH ACTUATING ROD

CROSS-REFERENCE TO RELATED APPLICATION

This application claims the benefit of U.S. Provisional Application Serial No. 60/114,855, filed Jan. 6, 1999, now abandoned.

FIELD OF THE INVENTION

This invention relates to firearms. More particularly, this invention relates to single-action revolvers.

BACKGROUND OF THE INVENTION

A revolver is a type of firearm that carries cartridges in the chambers of a rotating cylinder. A single-action revolver is fired by the shooter manually cocking the hammer and then pulling the trigger. The cocking of the hammer causes the cylinder to rotate one-sixth of a turn so that a new chamber is aligned with the hammer and barrel. The most famous single-action revolver of all time is the Colt single-action revolver. This handgun was first patented by Samuel Colt in 1835 and was produced in great numbers by the Colt Manufacturing Company during the mid and late 1800's.

The Colt single-action revolver handgun is shown in FIGS. 1 and 2. Omitting various fasteners and minor parts for brevity, the major parts shown are the barrel 1, ejector tube 2, ejector tube spring 4, ejector rod 5, ejector rod head 6, base pin 7, base pin screw 8, base pin spring 9, base pin nut 10, base pin bushing 11, frame 12, recoil plate 13, cylinder 14 (with longitudinal base pin bore, six longitudinal cartridge chambers, and ratchet), gate 15, hammer 16, firing pin 17, hand 21 (with hand spring), bolt 25, trigger 27, sear and bolt spring 28, trigger guard 31, mainspring 37, backstrap 38, and stock 42.

The Colt single-action revolver is loaded by inserting cartridges through the gate into the cylinder. The shooter then pulls the hammer back with the thumb of his shooting hand, or with some part of his other hand, until the hammer locks in place. The movement of the hammer causes the hand to engage the ratchet of the cylinder and rotate the cylinder. When the trigger is pulled, the hammer is released, the firing pin contacts the cartridge, and the bullet is fired out the barrel. Spent casings are ejected manually by pulling the ejector rod through the chamber containing the spent casing.

The Colt single-action revolver was the first reliable rapid firing handgun and earned the reputation as "the gun that tamed the Wild West." Single-action revolvers continue to be used today and are especially popular among hunters and competitors in shooting contests. The major disadvantage of the Colt single-action revolver is that it requires considerable skill and manual dexterity to fire rapidly.

Double-action revolvers were first introduced in the late 1800's. Double-action revolvers do not require the shooter to manually cock the hammer before firing. Instead, pulling the trigger causes the hammer to fall and then cock. Double-action revolvers are easier to fire rapidly, but many shooters do not like double-action revolvers as well as single-action revolvers for a number of reasons. First, the motion of the hammer cocking in a double-action revolver moves the revolver and interferes with precision shooting. Second, double-action action revolvers are more expensive than single-action revolvers. And third, double-action revolvers are, in general, not as strong or reliable as single-action revolvers. Accordingly, it would be very desirable to provide a single-action revolver that is easier to fire rapidly.

SUMMARY OF THE INVENTION

The general object of this invention is to provide an improved revolver. A more particular object is to provide a single-action revolver that is easier to fire rapidly. Another object is to provide a simple and economical method for converting a single-action revolver to more easily fire rapidly.

I have invented an improved single-action revolver that is easy to fire rapidly. The revolver comprises: (a) a frame that contains a longitudinal bore; (b) a barrel attached to the frame for directing a flight of a bullet; (c) a cylinder that rotates about a longitudinal bore that is coaxial with the longitudinal bore of the frame, that contains a plurality of longitudinal cartridge chambers, and that is secured in the frame; (d) a cocking hammer aligned behind the longitudinal bores of the frame and the cylinder for striking and firing cartridges; (e) a trigger for releasing a cocked hammer; (f) a stock attached to the frame for aiming the revolver; (g) a means for rotating the cylinder as the hammer is cocked to align successive chambers with the barrel and hammer; and (h) a hammer-cocking assembly comprising a reciprocating cylinder-actuating actuating rod with a proximate end that passes rearwardly through the respective longitudinal bores of the frame and cylinder to contact the hammer and with a distal end that extends forwardly along the barrel. A shooter can easily fire the revolver rapidly by first moving the cylinder-actuating rod with one hand to cock the hammer and rotate the cylinder, and by then pulling the trigger with another hand to release the hammer and fire the revolver.

The improved single-action revolver retains all the advantages of the original single-action revolver, namely, accuracy and simplicity, while adding the ability to easily fire rapidly. Converting an original single-action revolver to the rapid-firing revolver of this invention is a simple and economical process.

BRIEF DESCRIPTION OF THE DRAWINGS

FIG. 6 is a side elevational view thereof.

FIG. 7 is a bottom plan view of a selected portion thereof.

FIG. 8 is a sectional view thereof taken along line 8—8 of FIG. 6.

FIG. 9 is a front elevational view thereof.

FIG. 10 is a partial sectional bottom plan view of a selected portion thereof.

FIG. 11 is a sectional view thereof taken along line 11—11 of FIG. 7.

DETAILED DESCRIPTION OF THE INVENTION

The rapid-firing single-action revolver of this invention contains a hammer-cocking assembly that enables a shooter to rapidly cock the hammer with one hand while pulling the trigger with the other hand. The revolver can be in the form of a handgun or a rifle. As used herein, the term "handgun"

refers generally to a firearm that has a barrel length not greater than 12 inches and that has a stock in the form of a grip that fits within one hand. The term "rifle" refers generally to a firearm that has a barrel length greater than 12 inches and that has an extended stock that fits against the shoulder. However, it is understood that the structure of the moving parts of the revolver of this invention and its operation are essentially the same regardless whether it is the form of a handgun or rifle.

The preferred embodiment of a revolver in the rifle configuration is shown in FIGS. 3 to 11. The parts of the rapid-firing revolver are numbered with reference to the numbering of the conventional single-action revolver handgun shown in FIGS. 1 and 2. Parts which are unchanged are given the same number as the same part in the conventional revolver. Parts which are modified, but analogous to, parts in the conventional revolver are given the same number but with the letter "M" for "modified." Parts which are not analogous to parts in the conventional revolver are given the new numbers 51 to 54.

Figure 1:
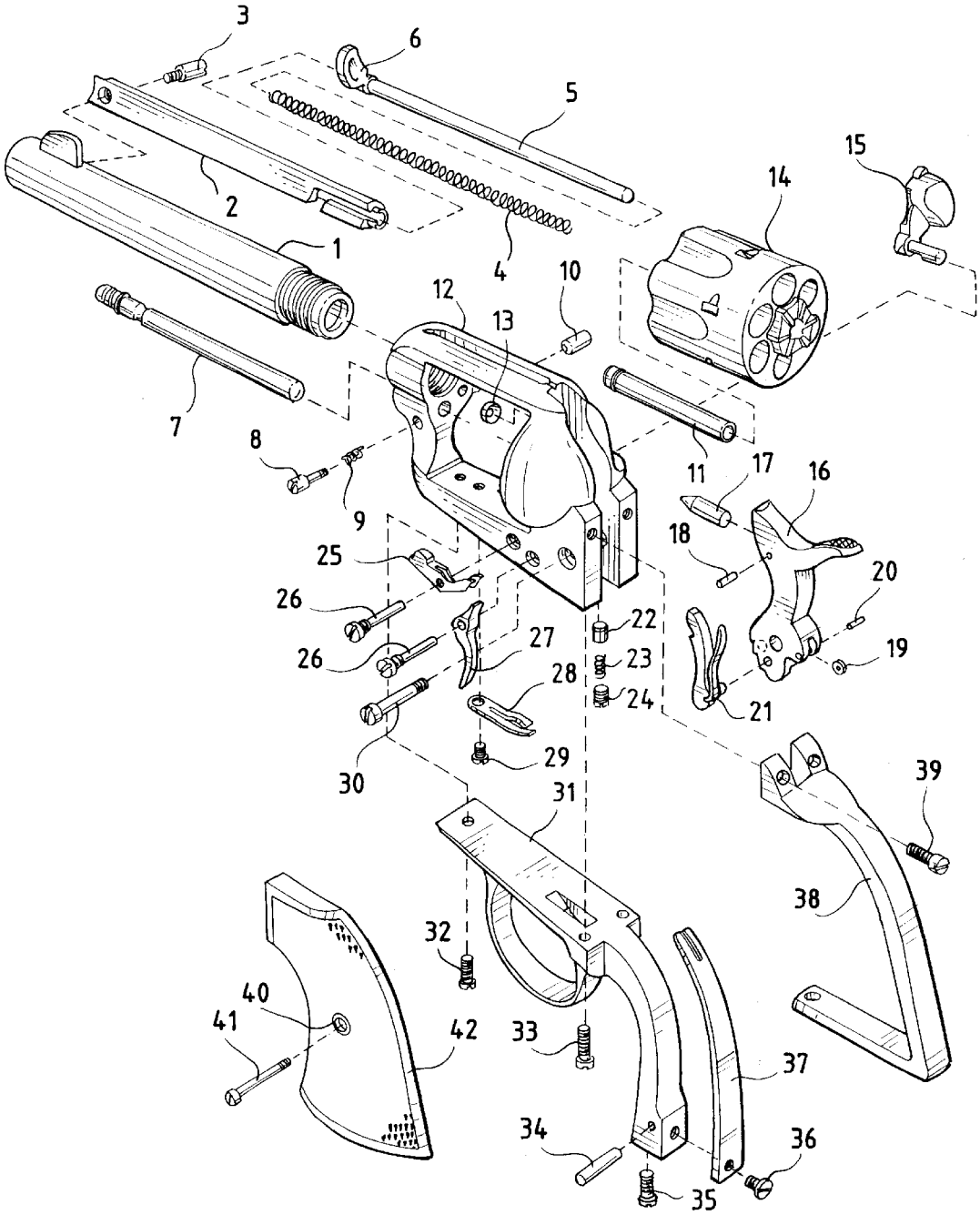
FIG. 1 PRIOR ART
FIG. 1 is an exploded rear and left side perspective view of a prior art single-action revolver.
Figure 2:
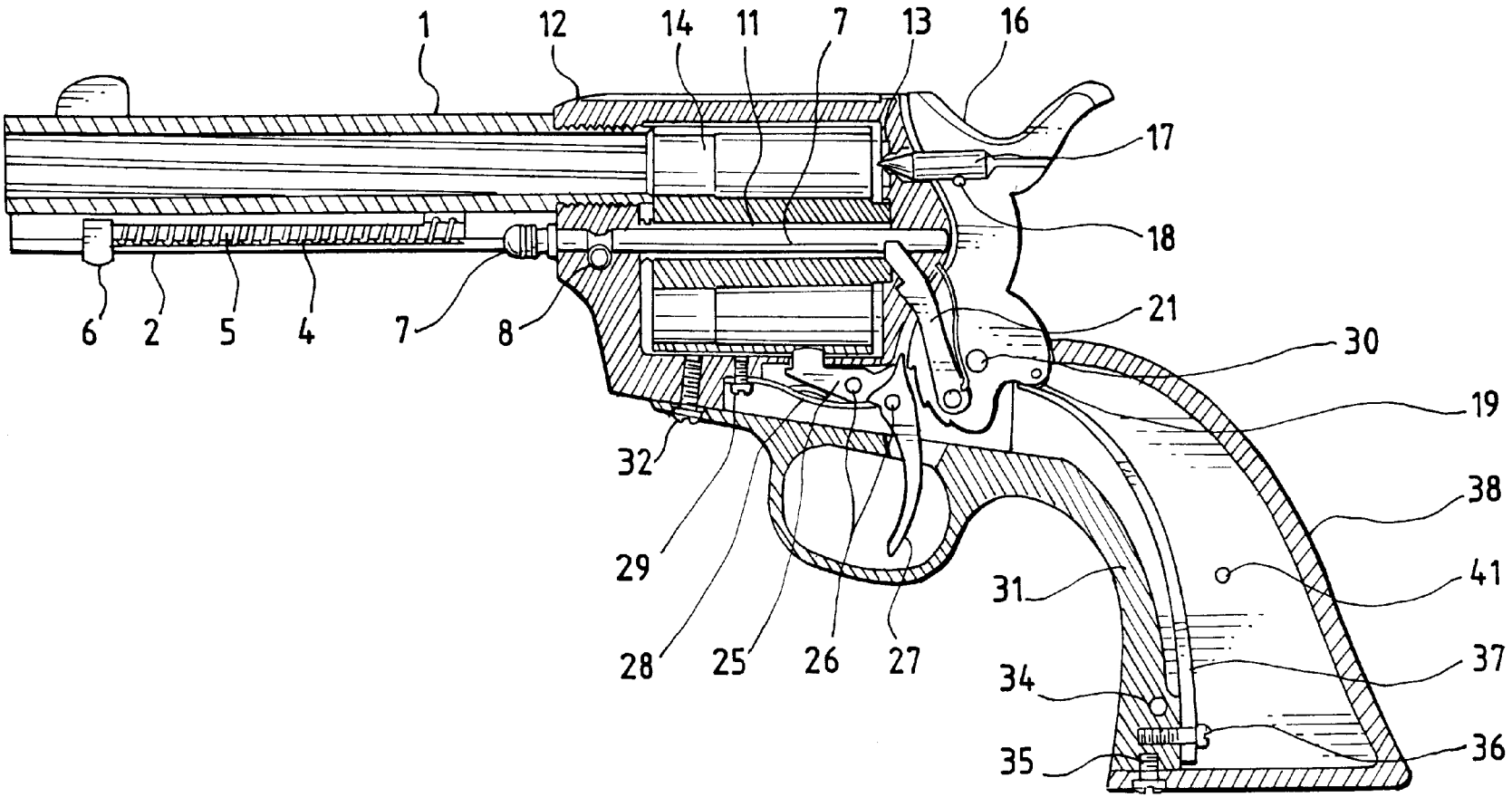
FIG. 2 PRIOR ART
FIG. 2 is a longitudinal sectional side elevational view of the revolver shown in FIG. 1.
Figure 3:
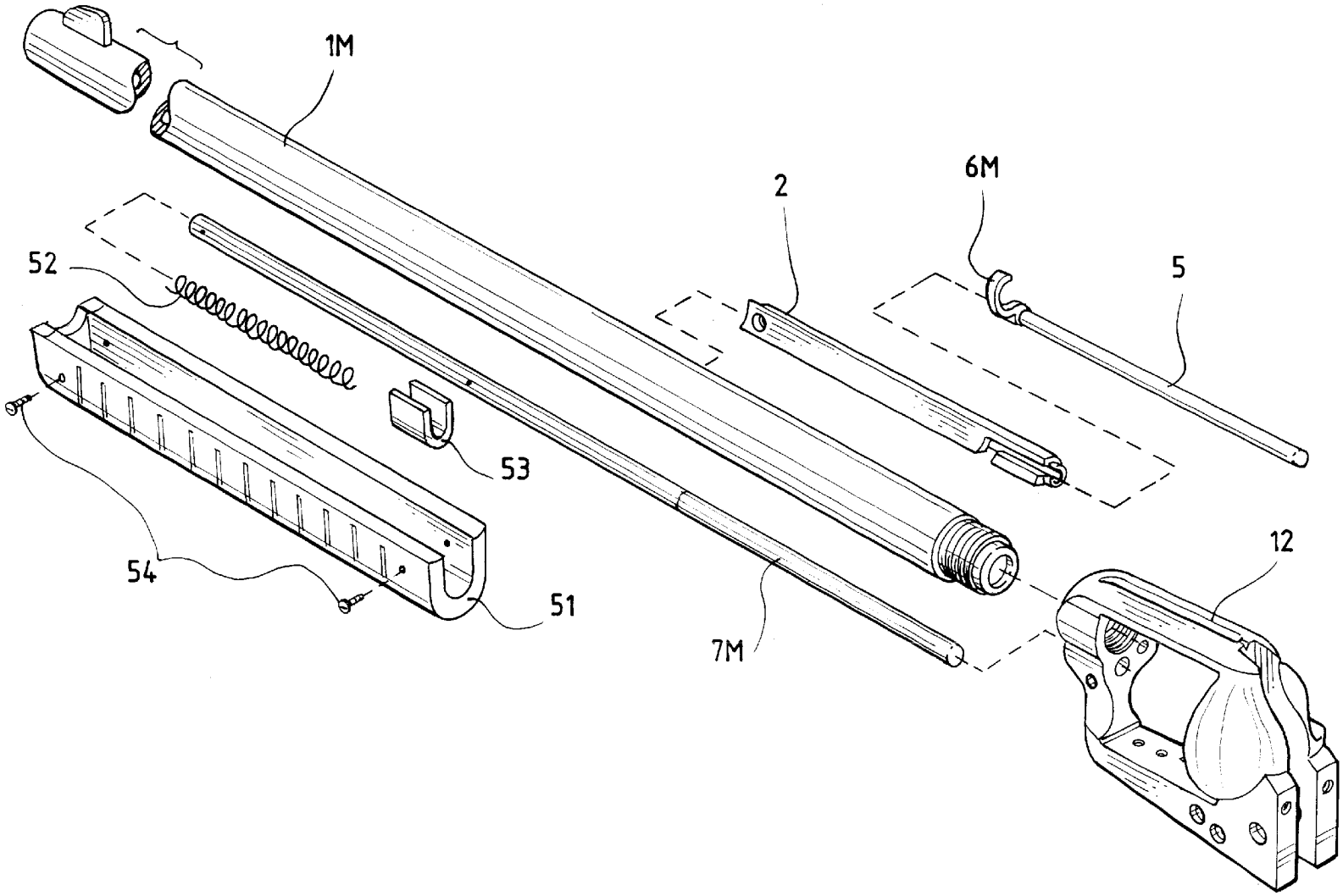
FIG. 3 is an exploded rear and left side perspective view of selected components of the preferred embodiment of the single-action revolver of this invention.

Referring now to FIG. 3, the rapid-firing revolver of this invention contains a barrel 1M that is longer than the barrel of the conventional revolver handgun. The rapid-firing revolver also contains a reciprocating cylinder actuating rod 7M which replaces the base pin of the conventional revolver. As will be seen, the actuating rod is one of the most important parts of the hammer-cocking assembly. The rapid-firing revolver also contains an ejector rod head 6M which contains a cut-out section to enable the actuating rod to extend beyond its head. Other parts of the hammer-cocking assembly are new. They include a fore-end 51, a fore-end return spring 52, a fore-end spring-retaining block 53, and fore-end screws 54. Each of these components is discussed in detail below. Numerous parts that are unchanged from the conventional revolver shown in FIGS. 1 and 2 are omitted from FIG. 3 for clarity.

Figure 4:
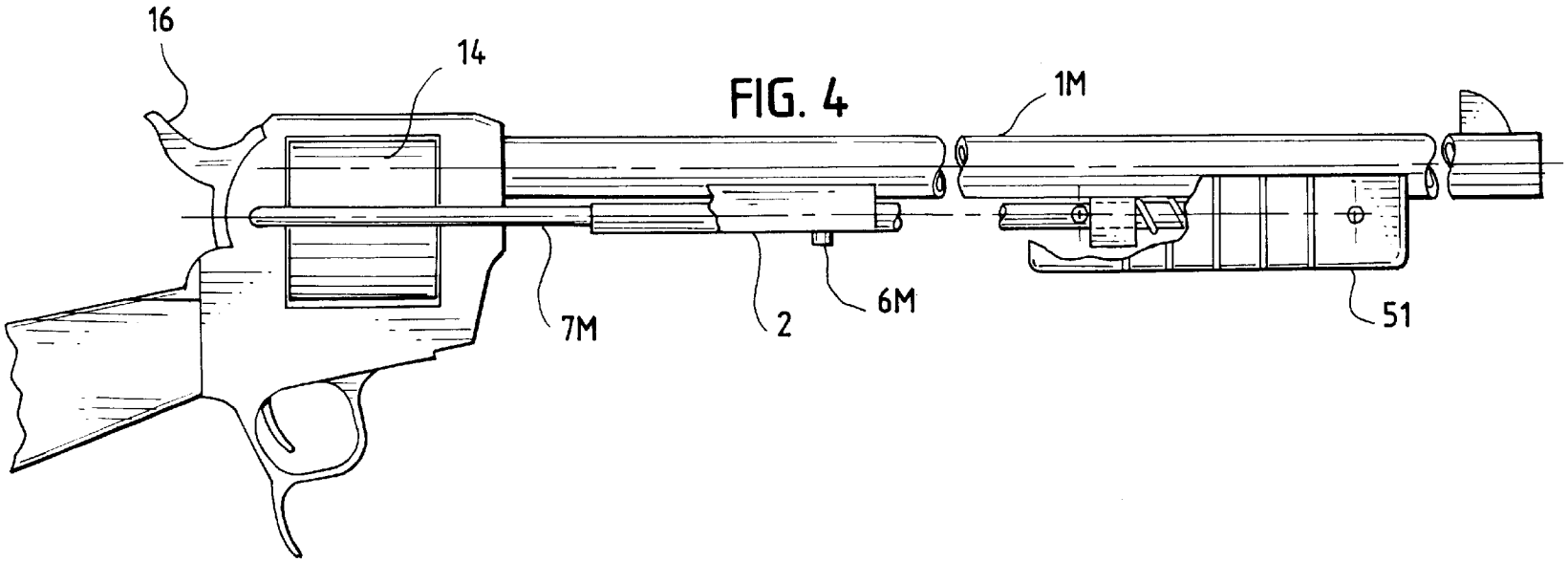
FIG. 4 is a partial sectional side elevational view thereof.
Figure 5:
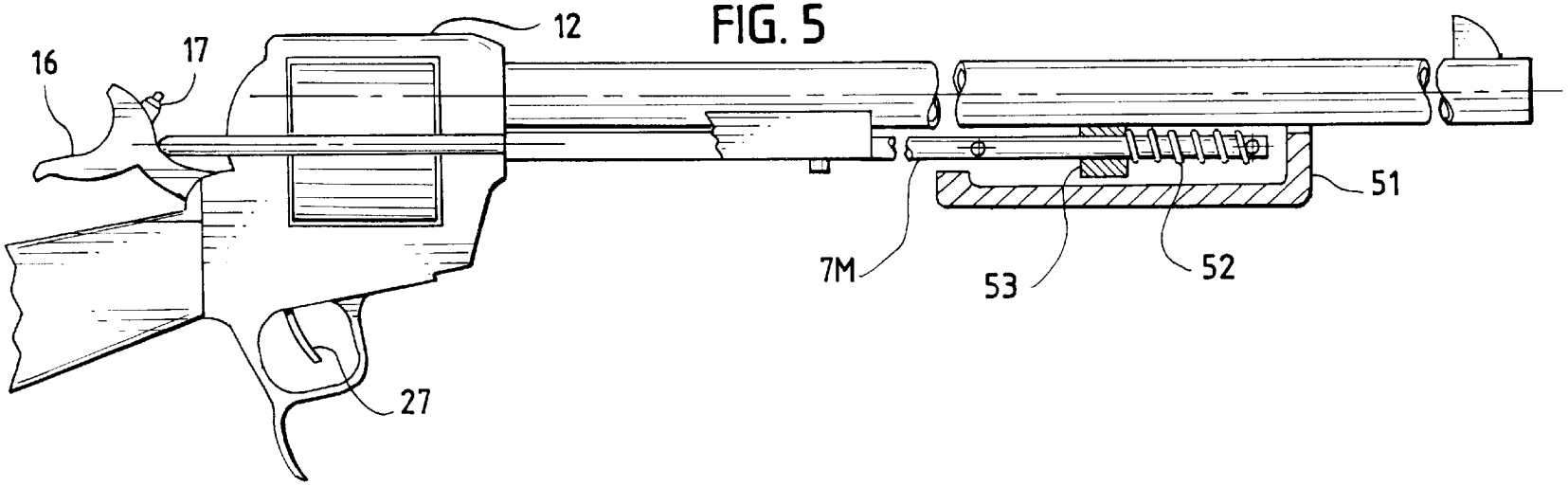
FIG. 5 is a partial sectional side elevational view thereof.

The reciprocating cylinder-actuating rod 7M serves two functions. Its first function is to replace the base pin of the conventional revolver which secures the cylinder in position in the frame. The cylinder-actuating rod's second function is to cock the hammer. These two functions are best seen in FIGS. 4 and 5. When the actuating rod is in the rest, or forwardly extending position, shown in FIG. 4, its only fiction is to secure the cylinder. It takes no other part in the operation of the revolver. In FIG. 5, the actuating rod is in the cocking, or rearwardly extending, position. Its proximate end pushes against the hammer to cock it. The rod still serves the cylinder-securing function in this position.

The length of the actuating rod in the preferred embodiment of the rifle configuration is about 14 inches (36 cm). This length enables the fore-end (discussed below) to be held with one hand at a comfortable distance while the trigger is held with the other hand. In the handgun configuration where compact size is desired, the actuating rod can be as short as about 6 inches (15 cm) so that the distal end of the rod extends forwardly of the frame for a short distance even when the proximate end of the rod is fully pulled back to cock the hammer. The shoulder stock (in the rifle configuration) and the grip stock (in the handgun configuration) are used to aim the revolver and are conventional.

The diameter of the actuating rod is similar or identical to that of the base pin which it replaces. In the preferred embodiment, the proximate end of the actuating rod has a diameter of 0.250 inches, exactly equal to the base pin, but the diameter increases to 0.284 inches (7 mm) at a distance of about 4 inches (10 cm) from the proximate end. This stepped-up diameter is best seen in FIG. 4. The increased diameter is larger than the diameter of the longitudinal bore in the frame and prevents the actuating rod from being pulled back so far that damage to the hammer is caused. In FIG. 5, it can be seen that the stepped-up diameter portion of the rod is in contact with, or is nearly in contact with, the frame when the rod is pulled back to fully cock the hammer.

In the preferred embodiment, a fore-end 51 is attached to the distal end of the actuating rod with a plurality of fore-end screws 5, two of which are shown in FIG. 3. The purpose of the fore-end is to provide a more secure grip for the shooter. The fore-end is similar in shape and construction to the fore-ends commonly used in pump action rifles.

As best seen in FIG. 5, it can be appreciated that the cylinder-actuating rod prevents the falling of the hammer and the firing of the revolver when it is in its rearwardly extending position. Accordingly, it is desirable to provide a means for urging the rod to its rest, or forwardly extending, position. In the preferred embodiment, the hammer-cocking assembly includes a fore-end return spring 52 and a fore-end return-spring-retaining block 53. The block is attached to the barrel by silver brazing, soldering, welding or the like. The spring is compressed between the block and the distal end of the fore-end.

The operation of the rapid-firing single-action revolver of this invention can now be considered. Cartridges are loaded through the gate into the cylinder in a conventional manner. The hammer is then cocked in one of two ways. First, the hammer can be pulled back in a conventional manner with the thumb of the shooting hand or with other hand. Second, the hammer can be cocked by pulling back on the actuating rod. It can be appreciated that, in either case, the motion of the hammer moving into the cocking position causes the hand to engage the ratchet of the cylinder and to rotate the cylinder. If the actuating rod were used to cock the hammer, it is then returned to its rest position and the revolver is ready for firing. When the actuating rod is used to cock the hammer, it is easy even for relatively unskilled shooters and/or shooters with limited manual dexterity to fire the single-action revolver at a rapid rate.

It can also be seen that there is no need to successively pull and release the trigger when the cylinder-actuating rod is used to cock the hammer. If the trigger is pulled continuously, the revolver will fire with each reciprocal movement of the actuating rod.

I claim:

1. A single-action revolver that is easy to fire rapidly, the revolver comprising:

(a) a frame that contains a longitudinal bore;

(b) a barrel attached to the frame for directing a flight of a bullet;

(c) a cylinder that rotates about a longitudinal bore that is coaxial with the longitudinal bore of the frame, that contains a plurality of longitudinal cartridge chambers, and that is secured in the frame;

(d) a cocking hammer aligned behind the longitudinal bores of the frame and the cylinder for striking and firing cartridges;

(e) a trigger for releasing a cocked hammer;

(f) a stock attached to the frame for aiming the revolver;

(g) a means for rotating the cylinder as the hammer is cocked to align successive chambers with the barrel and hammer; and (h) a hammer-cocking assembly comprising a reciprocating cylinder-actuating rod with a proximate end that passes rearwardly through the respective longitudinal bores of the frame and cylinder to contact the hammer and with a distal end that extends forwardly along the barrel; such that a shooter can easily fire the revolver rapidly by first moving the reciprocating cylinder-actuating rod with one hand to cock the hammer and rotate the cylinder, and by then pulling the trigger with another hand to release the hammer and fire the revolver.

2. The revolver of claim 1 wherein the hammer-cocking assembly additionally comprises a fore-end adapted for gripping attached to the distal end of the cylinder-actuating rod so that the rod is easily moved with a hand.

3. The revolver of claim 2 wherein the hammer-cocking assembly additionally comprises a fore-end spring and a spring-retaining block, the spring being compressed within the fore-end between the block and the fore-end, such that the force of the spring urges the fore-end away from the hammer.

4. An improved single-action revolver of the type comprising: (a) a frame that contains a longitudinal bore; (b) a barrel attached to the frame for directing a flight of a bullet; (c) a cylinder that rotates about a longitudinal bore that is coaxial with the longitudinal bore of the frame, that contains a plurality of longitudinal cartridge chambers, and that is secured in the frame; (d) a cocking hammer aligned behind the longitudinal bores of the frame and the cylinder for striking and firing cartridges; (e) a trigger for releasing a cocked hammer; (f) a stock attached to the frame for aiming the revolver; and (g) a means for rotating the cylinder as the hammer is cocked to align successive chambers with the barrel and hammer; wherein the improvement comprises a hammer-cocking assembly comprising a reciprocating cylinder-actuating rod with a proximate end that passes rearwardly through the respective longitudinal bores of the frame and cylinder to contact the hammer and with a distal end that extends forwardly along the barrel; such that a shooter can easily fire the revolver rapidly by first moving the cylinder-actuating rod with one hand to cock the hammer and rotate the cylinder, and by then pulling the trigger with another hand to release the hammer and fire the revolver.

5. The revolver of claim 4 wherein the hammer-cocking assembly additionally comprises a fore-end adapted for gripping attached to the distal end of the cylinder actuating rod so that the rod is easily moved with a hand.

6. The revolver of claim 5 wherein the hammer-cocking assembly additionally comprises a fore-end spring and a spring-retaining block, the spring being compressed within the fore-end between the block and the fore-end, such that the force of the spring urges the fore-end away from the hammer.

* * * * *